US010964263B2

(12) United States Patent
Kim et al.

(10) Patent No.: US 10,964,263 B2
(45) Date of Patent: Mar. 30, 2021

(54) DISPLAY DEVICE AND METHOD OF DRIVING THE SAME

(71) Applicant: Samsung Display Co., Ltd., Yongin-si (KR)

(72) Inventors: Sung Hwan Kim, Yongin-si (KR); Kyung Man Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/563,530

(22) Filed: Sep. 6, 2019

(65) Prior Publication Data

US 2020/0152123 A1 May 14, 2020

(30) Foreign Application Priority Data

Nov. 8, 2018 (KR) ..... 10-2018-0136834

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0809* (2013.01); *G09G 2310/0202* (2013.01); *G09G 2310/08* (2013.01)

(58) Field of Classification Search
CPC .. G09G 3/3233; G09G 3/3266; G09G 3/3275; G09G 3/3291; G09G 2300/0809; G09G 2300/0819; G09G 2300/0842; G09G 2310/08; G09G 2310/0202; G09G 2320/043; G09G 2320/0242; G09G 2320/0295
See application file for complete search history.

(56) References Cited

U.S. PATENT DOCUMENTS 8,334,825 B2 12/2012 Kim
2014/0176400 A1* 6/2014 Park ..... G09G 3/3291 345/76
2016/0042690 A1* 2/2016 Chang ..... G09G 3/3258 345/212

(Continued)

FOREIGN PATENT DOCUMENTS

KR 10-2016-0068995 A 6/2016
KR 10-2017-0081034 A 7/2017

*Primary Examiner* — Ryan A Lubit
(74) *Attorney, Agent, or Firm* — Lewis Roca Rothgerber Christie LLP

(57) ABSTRACT

A display device includes a display panel including a pixel coupled to a data line, a read-out line, a scan line, and a sensing line, a scan driver for generating scan and sensing signals to be supplied to the scan and sensing lines, a voltage controller for controlling a gate-on voltage of each of the scan and sensing signals to be supplied to the pixel during a mobility sensing period, a data driver for supplying a data signal to the data line, and a compensator for sensing current flowing from the pixel to the read-out line and compensate for the data signal, wherein the mobility sensing period includes a period during which each of the scan and sensing signals has a first voltage, a period during which the gate-on voltage of the scan and sensing signals changes, and a period during which the sensing signal has the first voltage.

19 Claims, 6 Drawing Sheets

(56) References Cited

U.S. PATENT DOCUMENTS

| | | | | |
|---|---|---|---|---|
| 2016/0189630 | A1* | 6/2016 | Chang | G09G 3/3233 345/211 |
| 2016/0203753 | A1* | 7/2016 | Hwang | G09G 3/2092 345/212 |
| 2017/0039952 | A1* | 2/2017 | Kim | G09G 3/3233 |
| 2017/0193923 | A1* | 7/2017 | Park | G09G 3/3258 |
| 2019/0066603 | A1* | 2/2019 | Lee | G09G 3/3233 |
| 2019/0103060 | A1* | 4/2019 | Kang | H01L 51/5206 |
| 2019/0197959 | A1* | 6/2019 | Noh | G09G 3/3233 |
| 2020/0043421 | A1* | 2/2020 | Kang | G09G 3/3266 |
| 2020/0082759 | A1* | 3/2020 | Lee | G09G 3/3233 |

* cited by examiner

DISPLAY DEVICE AND METHOD OF DRIVING THE SAME

CROSS-REFERENCE TO RELATED APPLICATION

This application claims priority to and the benefit of Korean patent application number 10-2018-0136834 filed on Nov. 8, 2018, the entire disclosure of which is incorporated herein in its entirety by reference.

BACKGROUND

1. Field

Aspects of embodiments of the present disclosure relate to a display device, and more particularly, to a display device and a method of driving the display device.

2. Description of Related Art

Generally, display devices (e.g., organic light-emitting display devices) including organic light-emitting diodes have characteristics of low-power driving, a thin thickness, a wide viewing angle, and a high response speed. Some display devices may perform an operation of sensing a threshold voltage or mobility of a driving transistor included in a pixel circuit, thereby compensating for degradation or a change in characteristics of the driving transistor outside the pixel circuit.

However, when the mobility of the driving transistor is compensated for, a gate voltage of the driving transistor may be undesirably changed by a kickback phenomenon due to a change in voltage level of a scan signal. In detail, the scan signal is supplied in the form of a pulse. When the scan signal is lowered from a high voltage level to a low voltage level, a problem may arise in that the gate voltage of the driving transistor is lowered by effects of the scan signal.

Thereby, a gate-source voltage (Vgs) of the driving transistor may change. Eventually, in the case where the voltage of the gate electrode of the driving transistor is changed by a kickback voltage, current flowing to the organic light-emitting diode or a sensing line via the driving transistor may undesirably change.

The above information disclosed in this Background section is only for enhancement of understanding of the background of the invention and therefore it may contain information that does not form the prior art.

SUMMARY

Aspects of embodiments of the present disclosure are directed to a display device capable of controlling gate-on voltages of a scan signal and a sensing signal during a mobility sensing period.

Aspects of embodiment of the present disclosure are directed to a method of driving the display device.

However, objects of the present disclosure are not limited to the above-described objects, and various suitable modifications are possible without departing from the spirit and scope of the present disclosure.

According to some embodiments of the present disclosure, there is provided a display device including: a display panel including a pixel coupled to a data line, a read-out line, a scan line, and a sensing line; a scan driver configured to generate a scan signal and a sensing signal to be respectively supplied to the scan line and the sensing line; a voltage controller configured to control a gate-on voltage of each of the scan signal and the sensing signal to be supplied to the pixel during a mobility sensing period; a data driver configured to supply a data signal to the data line; and a compensator configured to sense current flowing from the pixel to the read-out line and compensate for the data signal, wherein the mobility sensing period includes a first period during which each of the scan signal and the sensing signal has a first voltage, a second period during which the gate-on voltage of each of the scan signal and the sensing signal changes, and a third period during which the sensing signal has the first voltage again.

In some embodiments, during the second period, each of the scan signal and the sensing signal is reduced to a second voltage.

In some embodiments, during the third period, the scan signal has a third voltage lower than the second voltage.

In some embodiments, each of the first voltage and the second voltage is the gate-on voltage, and the third voltage is a gate-off voltage.

In some embodiments, a falling time at which the scan signal changes from the second voltage to the third voltage synchronizes with a rising time at which the sensing signal changes from the second voltage to the first voltage.

In some embodiments, the voltage controller includes: a multiplexer configured to output, in response to a first voltage control signal and a second voltage control signal, one of the first voltage and a kickback slice voltage that changes from the first voltage to the second voltage.

In some embodiments, during the second period, each of the scan signal and the sensing signal is reduced from the first voltage to the second voltage at a set rate.

In some embodiments, during the mobility sensing period, a period during which the sensing signal has the first voltage is longer than a period during which the scan signal has the first voltage.

In some embodiments, the mobility sensing period includes a plurality of first to third periods for each pixel row.

In some embodiments, the pixel includes: an organic light-emitting diode; a first transistor coupled between a first driving power supply and an anode electrode of the organic light-emitting diode, and including a gate electrode coupled to a first node; a second transistor coupled between the data line and the first node, and including a gate electrode configured to receive the scan signal; a third transistor coupled between the read-out line and the anode electrode of the organic light-emitting diode, and including a gate electrode configured to receive the sensing signal; and a storage capacitor coupled between the first node and the anode electrode of the organic light-emitting diode.

According to some embodiments of the present disclosure, there is provided a method of driving a display device, the method including: during a first period, supplying a scan signal having a first voltage to a k-th scan line (k being a natural number) and supplying a sensing signal having the first voltage to a k-th sensing line; during a second period, changing each of the scan signal and the sensing signal from the first voltage to a second voltage; and during a third period, supplying the sensing signal having a voltage higher than the second voltage.

In some embodiments, the first voltage is higher than the second voltage.

In some embodiments, during the third period, the scan signal has a third voltage lower than the second voltage.

In some embodiments, each of the first voltage and the second voltage is a gate-on voltage, and the third voltage is a gate-off voltage.

In some embodiments, a falling time at which the scan signal changes from the second voltage to the third voltage synchronizes with a rising time at which the sensing signal changes from the second voltage to the first voltage.

In some embodiments, during the second period, each of the scan signal and the sensing signal is reduced from the first voltage to the second voltage at a set rate.

In some embodiments, the first to third periods are during a mobility sensing period of a driving transistor of each of pixels in a k-th pixel row.

In some embodiments, the first to third periods are sequentially applied on a pixel row basis.

In some embodiments, the first to third periods are during a blank period of a frame and are selectively applied to some pixel rows.

As described above, in a display device and using a method of driving the display device in accordance with embodiments of the present disclosure, because a kickback slice is applied to a scan signal and a sensing signal during a mobility sensing period, and then the sensing signal is increased to a first voltage again, a loss of sensing current due to kickback and/or the kickback slice may be removed (or substantially reduced or minimized). Consequently, the mobility sensing accuracy may be enhanced.

However, effects of the present disclosure are not limited to the above-described effects, and various suitable modifications are possible without departing from the spirit and scope of the present disclosure.

DETAILED DESCRIPTION

Figure 1:
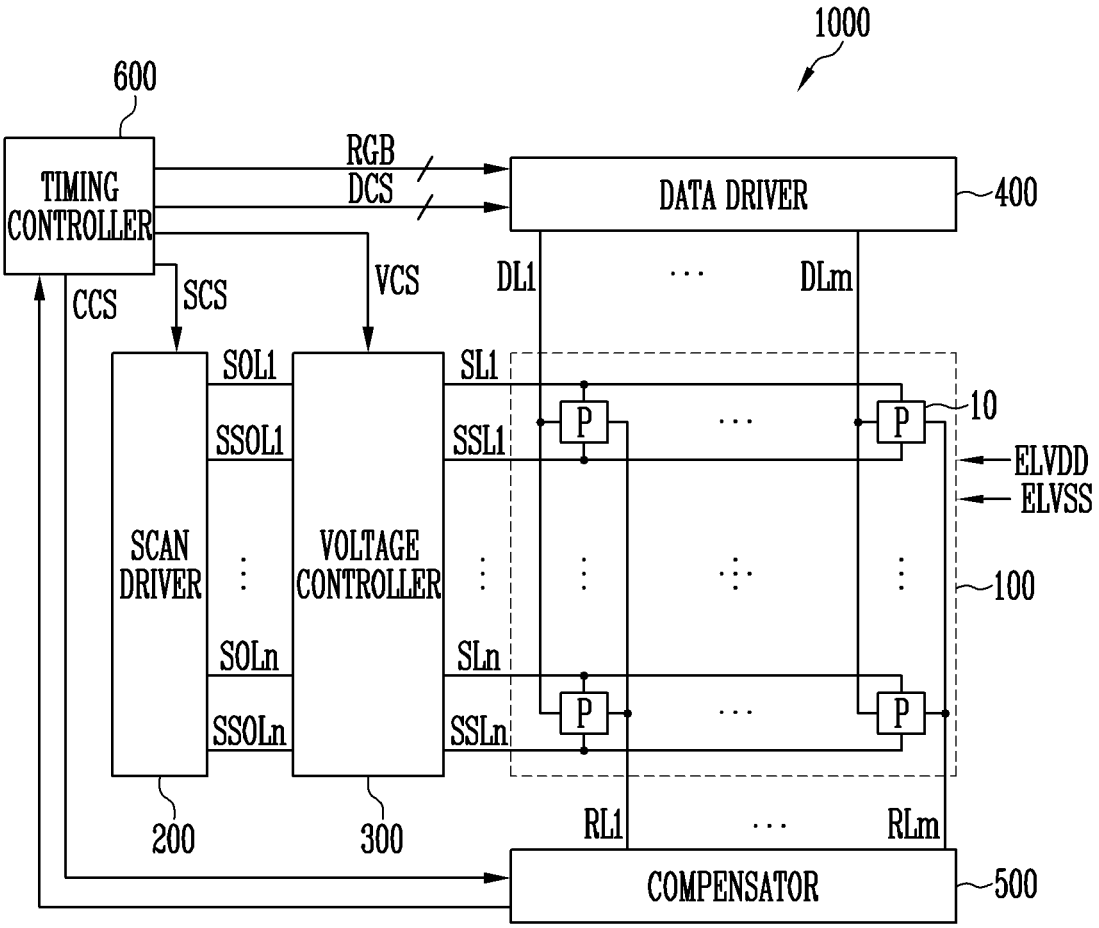
FIG. 1 is a block diagram illustrating a display device in accordance with some exemplary embodiments of the present disclosure.

Various embodiments of the present disclosure will hereinafter be described in detail with reference to the accompanying drawings. The same reference numerals are used throughout the different drawings to designate the same components, and repetitive description of the same components may be omitted.

FIG. 1 is a block diagram illustrating a display device 1000 in accordance with some exemplary embodiments of the present disclosure.

Referring to FIG. 1, the display device 1000 may include a display panel 100, a scan driver 200, a voltage controller 300, a data driver 400, a compensator 500, and a timing controller 600.

The display device 1000 may be implemented as an organic light emitting display device, a liquid crystal display device, a quantum dot display device, or the like. The display device 1000 may be a flat display device, a flexible display device, a curved display device, a foldable display device, a bendable display device, or the like. Furthermore, the display device 1000 may be applied to a transparent display device, a head-mounted display device, a wearable display device, or the like.

In an embodiment, the display device 1000 may be driven in a display mode for displaying an image, or may be driven in a sensing mode for sensing degradation of a pixel 10. The sensing mode may include a threshold voltage sensing period during which the threshold voltage of a driving transistor is sensed, and a mobility sensing period during which the mobility of the driving transistor is sensed. In addition, the sensing mode may further include an organic light-emitting diode sensing period during which the threshold voltage of an organic light-emitting diode included in the pixel 10 is sensed.

In an embodiment, the threshold voltage sensing period and/or the mobility sensing period may be inserted between display periods in which images are displayed. In some examples, the threshold voltage sensing period and/or the mobility sensing period may be inserted in a set or predetermined time when the display device 1000 is turned on/off.

The timing controller 600 may generate a first driving control signal SCS, a second driving control signal VCS, a third driving control signal DCS, and a fourth driving control signal CCS in response to synchronization signals supplied from an external device. Generated from the timing controller 600, the first driving control signal SCS may be supplied to the scan driver 200, the second driving control signal VCS may be supplied to the voltage controller 300, the third driving control signal DCS may be supplied to the data driver 400, and the fourth driving control signal CCS may be supplied to the compensator 500.

The first driving control signal SCS may include a scan start signal and clock signals. The scan start signal may control a first timing of a scan signal. The clock signals may be used to shift the scan start signal. The first driving control signal SCS may further include a sensing start signal. The sensing start signal may control a first timing of a sensing signal.

The second driving control signal VCS may control a timing of changing a gate-on voltage of a scan signal and/or a sensing signal. For example, the second driving control signal VCS may be enabled during the mobility sensing period of the display device 1000.

The third driving control signal DCS may include a source start signal and clock signals. The source start signal may control a data sampling start time. The clock signals may be used to control a sampling operation.

The fourth driving control signal CCS may control driving of the compensator 500 for pixel sensing and degradation compensation.

The display panel 100 may include pixels 10, which are coupled to scan lines SL1 to SLn (here, n is a natural number), sensing lines SSL1 to SSLn, data lines DL1 to DLm (here, m is a natural number), and read-out lines RL1 to RLm. The display panel 100 may be supplied with first driving power ELVDD and second driving power ELVSS from an external device.

The scan driver 200 may receive the first driving control signal SCS from the timing controller 600. The scan driver 200 that is supplied with the first driving control signal SCS may supply scan signals to scan output lines SOL1 to SOLn, and supply sensing signals to sensing output lines SSOL1 to SSOLn.

For example, the scan driver 200 may sequentially supply the scan signals to the scan output lines SOL1 to SOLn. If the scan signals are sequentially supplied to the scan output lines SOL1 to SOLn, the pixels 10 may be selected on a horizontal line basis. To this end, the scan signals may be set to a gate-on voltage (e.g., a logic high level) so that transistors included in the pixels 10 may be turned on.

The voltage controller 300 may control gate-on voltages of the scan signals and the sensing signals in response to the second driving control signal VCS. In an embodiment, the voltage controller 300 may be activated during the mobility sensing period.

The voltage controller 300 may control the gate-on voltages of the scan signals and the sensing signals that are output from the scan driver 200 during the mobility sensing period. In an embodiment, the scan signals and the sensing signals may have a kickback slice, which changes from a first voltage to a second voltage for a set or predetermined time of the mobility sensing period.

Although FIG. 1 illustrates that the voltage controller 300 receives the output of the scan driver 200, the configuration of the voltage controller 300 is not limited thereto. For example, a configuration of at least a portion of the voltage controller 300 may be included in the timing controller 600 and/or the scan driver 200. Furthermore, the output of the voltage controller 300 may be provided to the scan driver 200, and the scan driver 200 may output scan signals and/or sensing signals having voltage levels based on the output of the voltage controller 300.

The data driver 400 may be supplied with the third driving control signal DCS from the timing controller 600. The data driver 400 that is supplied with the third driving control signal DCS may supply data signals to the data lines DL1 to DLm. The data signals supplied to the data lines DL1 to DLm may be supplied to pixels 10 that are selected by a scan signal. To this end, the data driver 400 may supply the data signals to the data lines DL1 to DLm in synchronization with (e.g., simultaneous or concurrent with) the scan signal.

The compensator 500 may be supplied with the fourth driving control signal CCS from the timing controller 600. The compensator 500 that is supplied with the fourth driving control signal CCS may generate compensation values for compensating for degradation of the pixels 10 based on sensing values provided from the read-out lines RL1 to RLm. For example, the compensator 500 may detect and compensate for a change in threshold voltage of a driving transistor included in each pixel 10, a change in mobility, a change in characteristics of an organic light-emitting diode.

In an embodiment, during the sensing period, the compensator 500 may receive the current or voltage extracted from each pixel 10 through the read-out lines RL1 to RLm. The extracted current or voltage may correspond to a sensing value, and the compensator 500 may detect a change in characteristics of the driving transistor and/or the organic light-emitting diode based on a change in sensing value. The compensator 500 may calculate a compensation value for compensating for image data RGB or a data signal corresponding to the image data RGB based on the detected sensing value. The compensation value may be provided to the timing controller 600 or the data driver 400.

During the display period, the compensator 500 may supply a set or predetermined reference voltage for image display to the display panel 100 through the read-out lines RL1 to RLm. During the sensing period, the compensator 500 may supply a set or predetermined reference voltage for sensing or an initialization voltage to the display panel 100 through the read-out lines RL1 to RLm.

Although FIG. 1 illustrates that the compensator 500 is a component separated from the other components, a configuration of at least a portion of the compensator 500 may be included in the timing controller 600 and/or the data driver 400.

Although FIG. 1 illustrates the n scan lines SL1 to SLn and the n sensing lines SSL1 to SSLn, the present disclosure is not limited thereto. For example, one or more additional scan lines, one or more emission control lines, one or more additional read-out lines, one or more additional sensing lines, and/or the like, may be formed on the display panel 100 depending on a circuit structure of each pixel 10.

In an embodiment, the transistors included in the display device 1000 may be N-type oxide thin-film transistors. For example, an oxide thin-film transistor may be a low-temperature polycrystalline oxide (LTPO) thin-film transistor. However, this is only for illustrative purposes, and the N-type transistors are not limited thereto. For example, an active pattern (e.g., a semiconductor layer) included in each transistor may include an inorganic semiconductor (e.g., amorphous silicon, poly silicon) or an organic semiconductor.

Furthermore, at least one of the transistors included in the display device 1000 may be replaced with a P-type transistor. For example, the P-type transistor may be a P-channel metal oxide semiconductor (PMOS) transistor.

Figure 2:
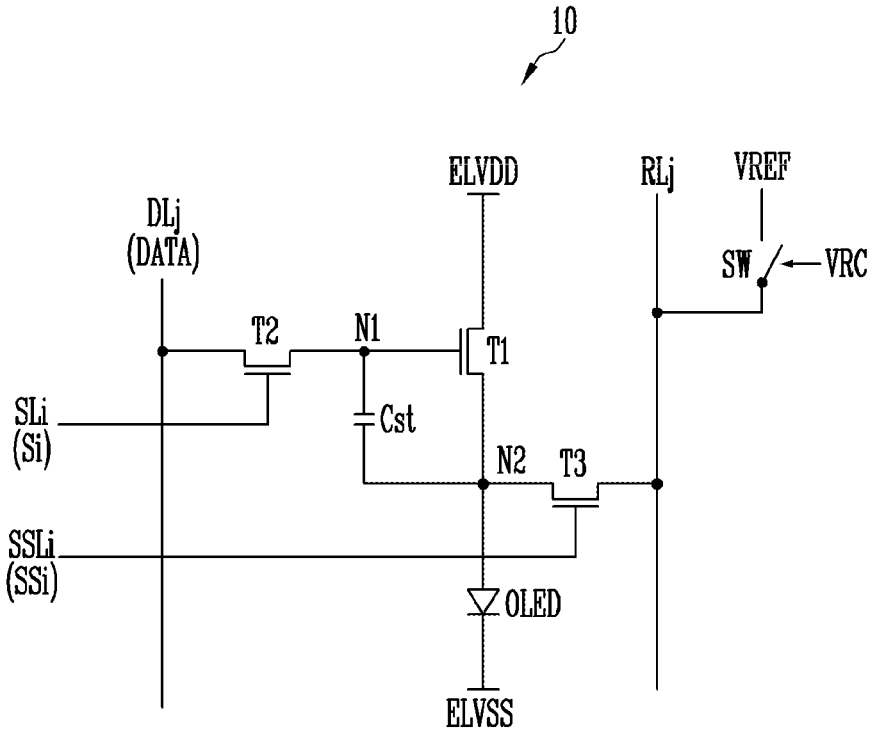
FIG. 2 is a circuit diagram illustrating an example of a pixel included in the display device of FIG. 1.

FIG. 2 is a circuit diagram illustrating an example of a pixel 10 included in the display device of FIG. 1.

The pixel 10 of FIG. 2 may be a pixel coupled to an i-th scan line SLi and a j-th data line DLj (here, i and j are natural numbers).

Referring to FIG. 2, the pixel 10 may include an organic light-emitting diode OLED, a first transistor (e.g., a driving transistor) T1, a second transistor T2, a third transistor T3, and a storage capacitor Cst.

An anode electrode of the organic light-emitting diode OLED may be coupled to a second electrode of the first transistor T1, and a cathode electrode thereof may be coupled to the second driving power supply ELVSS. The organic light-emitting diode OLED may emit light having a set or predetermined luminance corresponding to current supplied from the first transistor T1.

A first electrode of the first transistor T1 may be coupled to the first driving power supply ELVDD, and the second electrode thereof may be coupled to the anode electrode of the organic light-emitting diode OLED. A gate electrode of the first transistor T1 may be coupled to a first node N1. The first transistor T1 may control the amount of current flowing to the organic light-emitting diode OLED in response to the voltage of the first node N1.

A first electrode of the second transistor T2 may be coupled to the data line DLj, and a second electrode thereof is coupled to the first node N1. A gate electrode of the second transistor T2 may be coupled to the scan line SLi. When a scan signal Si is supplied to the scan line SLi, the second transistor T2 may be turned on to transmit a data signal (data voltage) DATA from the data line DLj to the first node N1.

The storage capacitor Cst may be coupled between the first node N1 and the anode electrode of the organic light-emitting diode OLED. The storage capacitor Cst may store the voltage of the first node N1.

The third transistor T3 may be coupled between a read-out line RLj and the first electrode (i.e., a second node N2) of the first transistor T1. The third transistor T3 may transmit sensing current to the read-out line RLj in response to a sensing signal SSi. The sensing current may be provided to the compensator 500. For example, the sensing current may be used to calculate changes in mobility and threshold voltage of the first transistor T1. Information about the mobility and the threshold voltage may be calculated based on the relationship between the sensing current and a voltage for sensing. In an embodiment, the sensing current may be converted into the form of a voltage and thus used for a compensation operation.

Figure 3:
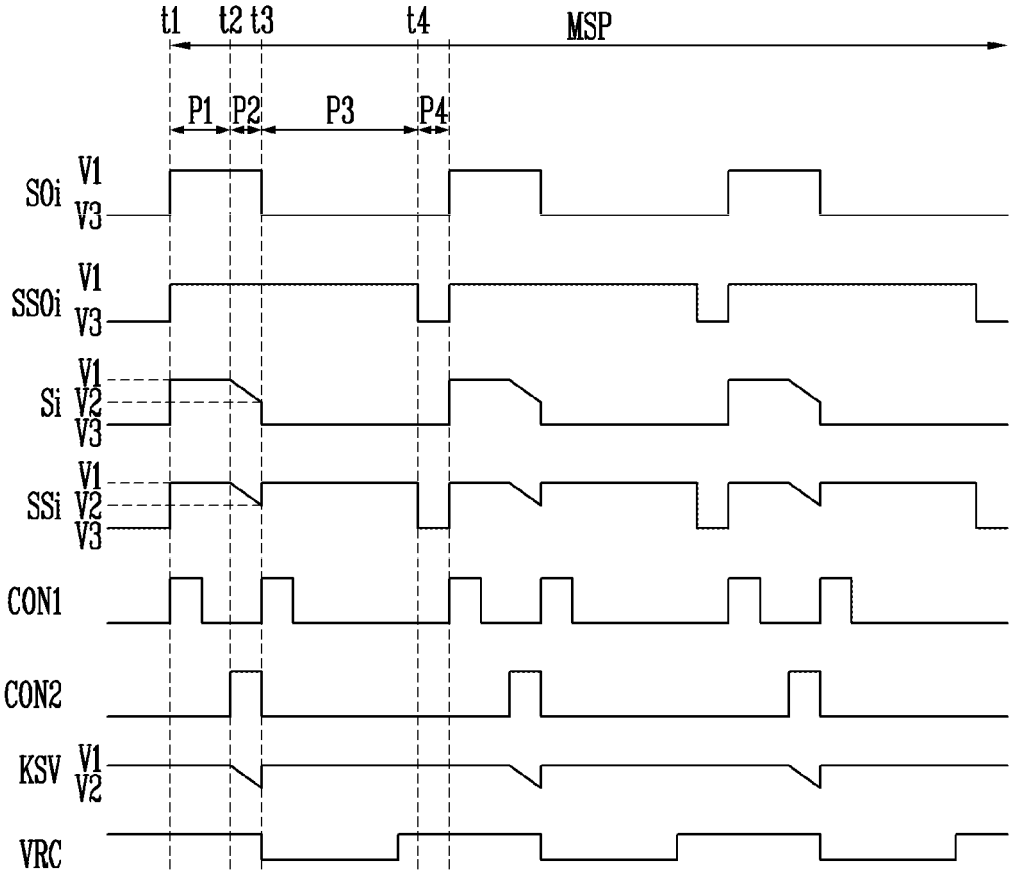
FIG. 3 is a timing diagram illustrating an example of a method of driving the display device in accordance with some exemplary embodiments of the present disclosure.

FIG. 3 is a timing diagram illustrating an example of a method of driving the display device 1000 in accordance with some exemplary embodiments of the present disclosure.

Referring to FIGS. 1 to 3, the display device 1000 may sense the mobility of the first transistor (e.g., a driving transistor) T1 included in the pixel 10 during a mobility sensing period MSP.

The mobility sensing period MSP may include first to third periods P1 to P3. In an embodiment, during the mobility sensing period MSP, a mobility sensing operation may be performed a plurality of times on one pixel row. For example, as illustrated in FIG. 3, the operation of sensing the mobility of a pixel 10 included in an i-th pixel row may be performed three times. In other words, the mobility sensing period MSP may include a plurality of first to third periods P1 to P3 for each pixel row. Here, the pixel row may be a group of pixels coupled in common to a single scan line.

During a mobility sensing operation, the scan signal Si may have a gate-on voltage during the first and second periods P1 and P2, and the sensing signal SSi may have a gate-on voltage during the first to third periods P1 to P3. The first and second periods P1 and P2 may be a period of inputting a data voltage DATA for sensing, and the third period P3 may be a current sensing period.

A scan output signal SOi, which is output from the scan driver 200 to a scan output line SOLi, may have a first voltage V1 during the first and second periods P1 and P2 and have a third voltage V3 during the third period P3. The first voltage V1 may be a gate-on voltage, and the third voltage V3 may be a gate-off voltage. For example, the first voltage V1 may be approximately 23 V, and the third voltage V3 may be approximately −3 V.

A sensing output signal SSOi, which is output from the scan driver 200 to a sensing output line SSOLi, may have a first voltage V1 during the first to third periods P1 to P3.

Thereafter, during a fourth period P4, each of the scan output signal SOi and the sensing output signal SSOi may have a third voltage V3, which is a gate-off voltage.

In an embodiment, in response to a first voltage control signal CON1, a second voltage control signal CON2, and a kickback slice voltage KSV, the gate-on voltage levels of the scan output signal SOi and the sensing output signal SSOi may change. The scan signal Si and the sensing signal SSi, the gate-on voltages of which have been controlled, may be supplied (or substantially supplied) to the pixel 10.

During the first period P1, the scan signal Si and the sensing signal SSi, each of which has the first voltage V1, may be supplied to the pixel 10. In response to the scan signal Si and the sensing SSi, the second and third transistors T2 and T3 may be turned on. Thereby, the data voltage DATA may be supplied to the first node N1, and a reference voltage VREF may be supplied to the second node N2 along a read-out line RLi. A voltage corresponding to a voltage difference between the first node N1 and the second node N2 may be charged into (e.g., stored by) the storage capacitor Cst.

In an embodiment, at a first time t1, in synchronization with (e.g., simultaneous or concurrent with) the first voltage control signal CON1, the scan output signal SOi and the sensing output signal SSOi may be output as the scan signal Si and the sensing signal SSi. The first voltage control signal CON1 may be a control signal allowing the scan output signal SOi and the sensing output signal SSOi to be output.

During the first and second periods P1 and P2, the reference voltage VREF may be supplied to the read-out line RLj in response to a control signal VRC for controlling a switch SW.

In the case where the scan output signal SOi and the sensing output signal SSOi are directly supplied to the pixel 10, at a falling time of the scan output signal SOi, that is, at a third time t3, a kickback phenomenon in which the gate voltage of the first transistor T1 is undesirably reduced by a rapid change of the scan output signal SOi may occur. Thereby, the amount of current flowing through the first transistor T1 may undesirably change.

To remove the kickback phenomenon, during the second period P2, a kickback slice may be applied to the scan output signal SOi and the sensing output signal SSOi. In an embodiment, during the second period P2, the gate-on voltages of the scan signal Si and the sensing signal SSi may change. For example, during the second period P2, each of the scan signal Si and the sensing signal SSi may be reduced from the first voltage V1 to a second voltage V2. In an embodiment, the second voltage V2 may be approximately 10 V.

During the second period P2, the scan signal Si and the sensing signal SSi may be reduced at a set or predetermined rate (e.g., a set gradient). Here, the kickback slice may be a change in voltage of the scan signal Si and/or sensing signal SSi during the second period P2.

The kickback phenomenon in which the gate voltage of the first transistor T1 is reduced may be substantially reduced or minimized by the kickback slice in the second period P2.

In an embodiment, at a second time t2, the second voltage control signal CON2 is supplied to the voltage controller 300. In synchronization with (e.g., simultaneous or concurrent with) the second voltage control signal CON2, the voltages of the scan signal Si and the sensing signal SSi may be reduced. For example, in response to the second voltage control signal CON2, a kickback slice voltage KSV may be output as the scan signal Si and the sensing signal SSi.

The kickback slice voltage KSV may have a sawtooth voltage waveform, which drops from the first voltage V1 to the second voltage V2.

Since the second voltage V2 is also a gate-on voltage, the second and third transistors T2 and T3 may remain turned on during the second period P2.

Thereafter, at the third time t3, the first voltage control signal CON1 may be supplied again. At the third time t3, in synchronization with (e.g., simultaneous or concurrent with) the first voltage control signal CON1, the scan output signal SOi and the sensing output signal SSOi may be output as the scan signal Si and the sensing signal SSi. In other words, a falling time at which the scan signal Si changes from the second voltage V2 to the third voltage V3 may synchronize with (e.g., be simultaneous with) a rising time at which the sensing signal SSi changes from the second voltage V2 to the first voltage V1.

Thereby, at the third time t3, the scan signal Si is changed to the third voltage V3, and the second transistor t2 may be turned off.

During the third period P3, the switch SW that supplies the reference voltage VREF may be turned off in response to the control signal VRC, and the sensing current of the first transistor T1 may be supplied to the compensator 500 through the read-out line RLj.

In the case where the sensing signal SSi that remains reduced to the second voltage V2 is supplied to the third transistor T3 even during the third period P3, the third transistor T3 may not be completely turned on. If the third transistor T3 is not completely turned on during the third period P3, the sensing value to be supplied to the compensator 500 may vary. In other words, there is a likelihood of a reduction in accuracy of sensing and compensation for degradation due to the kickback slice.

At this third time t3, the sensing signal SSi may be controlled to have the first voltage V1 again. In other words, at the third time t3, the sensing signal SSi may increase from the second voltage V2 to the first voltage V1. For example, at the third time t3, the sensing output signal SSOi may be output as the sensing signal SSi in synchronization with (e.g., simultaneous or concurrent with) the first voltage control signal CON1.

Hence, during the third period P3 in which the sensing value (e.g., the sensing current) is supplied to the read-out line RLj, the third transistor T3 may stably remain turned on.

However, this is only for illustrative purposes, and the voltage level of the sensing signal SSi during the third period P3 is not limited thereto. For example, during the third period P3, the sensing signal SSi may have a voltage level, which is higher than the second voltage V2 and is able to completely turn on the third transistor T3. In other words, the voltage level of the sensing signal SSi during the third period P3 may differ from the first voltage V1.

Subsequently, at a fourth time t4, each of the sensing output signal SSOi and the sensing signal SSi may have the third voltage V3, and the mobility sensing operation may be terminated.

The first to fourth periods P1 to P4 may be repeated by a preset number of times, and the compensation operation may be performed based on sensing values extracted a plurality of times. Consequently, the sensing accuracy on each pixel row may be improved.

As described above, in the display device 1000 and the method of driving the display device 1000 in accordance with embodiments of the present disclosure, since during the mobility sensing period MSP a kickback slice is applied to the scan signal Si and the sensing signal SSi and then the sensing signal SSi is increased to the first voltage V1 again, a loss of sensing current due to kickback and/or the kickback slice may be removed (or substantially reduced or minimized). Consequently, the mobility sensing accuracy may be enhanced.

Figure 4:
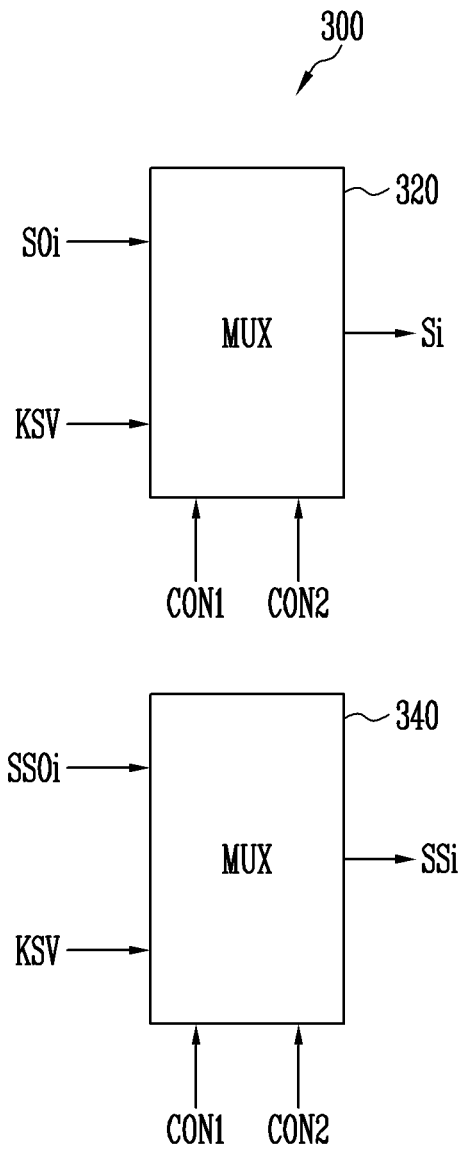
FIG. 4 is a diagram illustrating an example of a voltage controller included in the display device of FIG. 1.

FIG. 4 is a diagram illustrating an example of the voltage controller 300 included in the display device 1000 of FIG. 1.

Referring to FIGS. 1 to 4, the voltage controller 300 may include multiplexers 320 and 340 that output, in response to the first voltage control signal CON1 and the second voltage control signal CON2, one of the first voltage V1 and the kickback slice voltage KSV that changes from the first voltage V1 to the second voltage V2.

The first multiplexer 320 may receive the scan output signal SOi and the kickback slice voltage KSV, and output any one of the scan output signal SOi and the kickback slice voltage KSV as the scan signal Si. The first voltage control signal CON1 may be a signal for selecting the scan output signal SOi. The second voltage control signal CON2 may be a signal for selecting the kickback slice voltage KSV.

The second multiplexer 340 may receive the sensing output signal SSOi and the kickback slice voltage KSV, and output any one of the sensing output signal SOi and the kickback slice voltage KSV as the sensing signal SSi. The first voltage control signal CON1 may be a signal for selecting the sensing output signal SSOi. The second voltage control signal CON2 may be a signal for selecting the kickback slice voltage KSV.

As illustrated in FIG. 3, the scan output signal SOi and the sensing output signal SSOi may be output in synchronization with (e.g., simultaneous or concurrent with) the first control signal CON1. The kickback slice voltage KSV may be output in synchronization with (e.g., simultaneous or concurrent with) the second control signal CON2.

However, this is only for illustrative purposes, and the configuration and operation of the voltage controller 300 that controls the gate-on voltage levels of the scan signal Si and the sensing signal SSi are not limited thereto.

Figure 5:
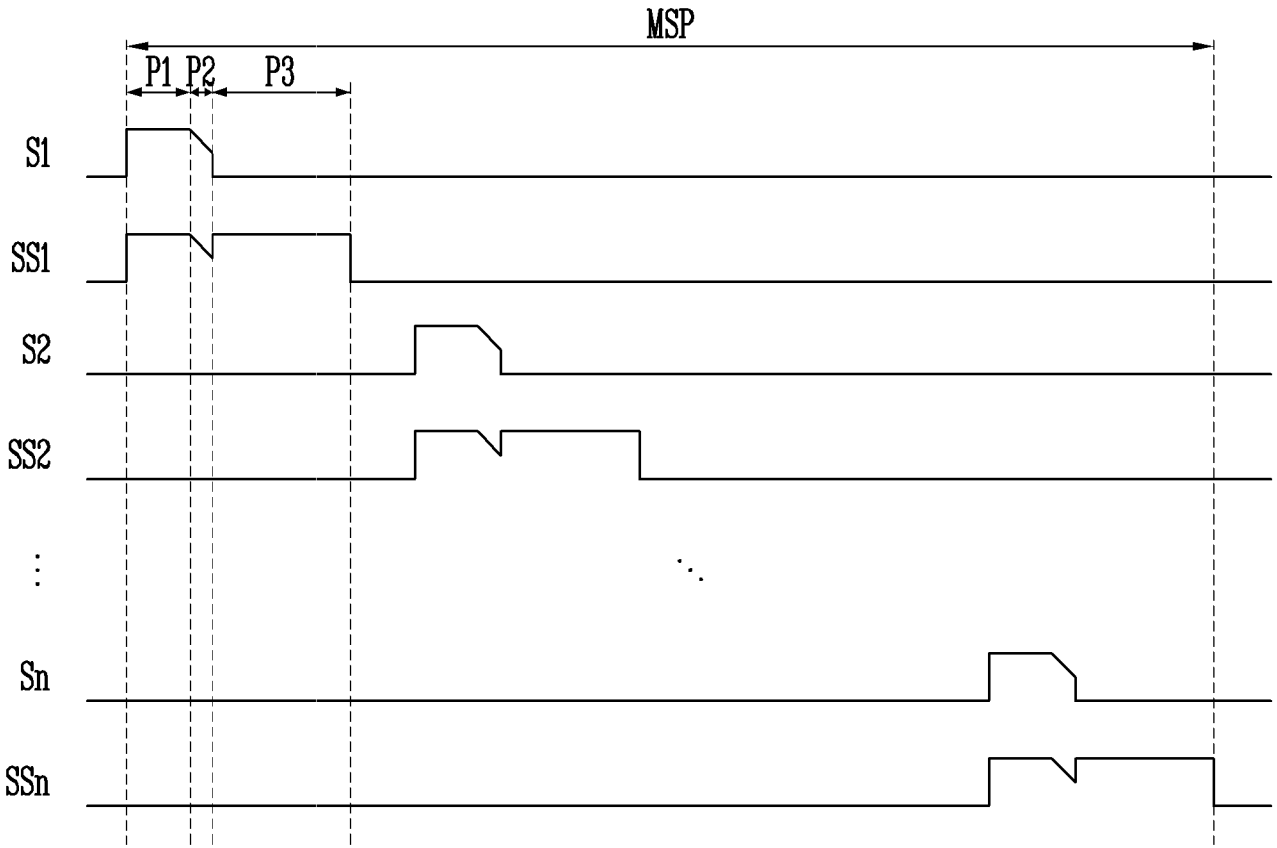
FIG. 5 is a timing diagram illustrating an example of a method of driving the display device of FIG. 1.

FIG. 5 is a timing diagram illustrating an example of a method of driving the display device 1000 of FIG. 1.

Referring to FIGS. 1, 2, 3, and 5, the display device 1000 may sense the mobility of the pixels 10 during the mobility sensing period MSP.

During the mobility sensing period MSP, a length of a gate-on period of each of the sensing signals SS1 to SSn to be supplied to the sensing lines SSL1 to SSLn may be greater than a length of a gate-on period of each of the scan signals S1 to Sn to be supplied to the scan lines SL1 to SLn.

In an embodiment, the mobility sensing period MSP may be generated by a command of turning on or off the display device 1000. In other words, when the display device 1000 is turned on or off, the mobility sensing operation may be performed.

In an embodiment, the mobility sensing may be sequentially performed from a first pixel row to an n-th pixel row. In other words, as illustrated in FIG. 5, the first to third periods P1 to P3 of the scan signal and the sensing signal may be sequentially applied on a pixel row basis.

Figure 6:
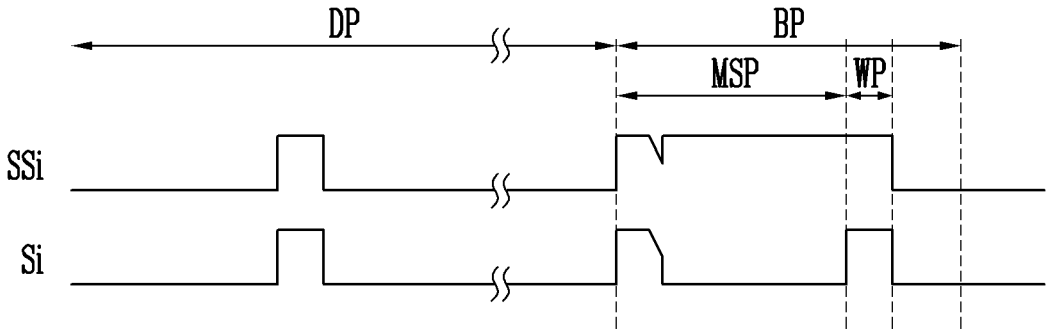
FIG. 6 is a timing diagram illustrating an example of a method of driving the display device of FIG. 1.

FIG. 6 is a timing diagram illustrating an example of a method of driving the display device 1000 of FIG. 1.

Referring to FIGS. 1, 2, 3, and 6, the mobility sensing period MSP of the display device 1000 may be included in a blank period BP of a frame.

During the display period DP, the scan signal Si and the sensing signal SSi may simultaneously have gate-on voltages. Here, the pixel 10 may emit light at a luminance corresponding to a supplied data voltage.

In an embodiment, during the blank period BP, the mobility sensing operation may be selectively applied to some pixel rows. For example, during the blank period BP, scan signals and sensing signals corresponding to one or two arbitrary pixel rows may be supplied. FIG. 6 illustrates an example where the mobility sensing operation is performed on an i-th pixel row during the blank period BP.

During the mobility sensing period MSP, an operation of inputting a data voltage DATA and a current sensing operation may be performed.

Thereafter, during a data rewrite period WP, the sensing signal Si may have the gate-on voltage (e.g., the first voltage V1) again. During the data rewrite period WP, the sensing signal SSi may maintain the first voltage V1. The data voltage DATA of the current frame may be reapplied to the pixel 10. Therefore, the pixel 10 may reemit light at the same (or substantially the same) luminance as that of the light that has been emitted during the display period DP of the current frame. Consequently, image distortion due to the mobility sensing operation during the blank period BP may be substantially reduced or prevented.

Figure 7:
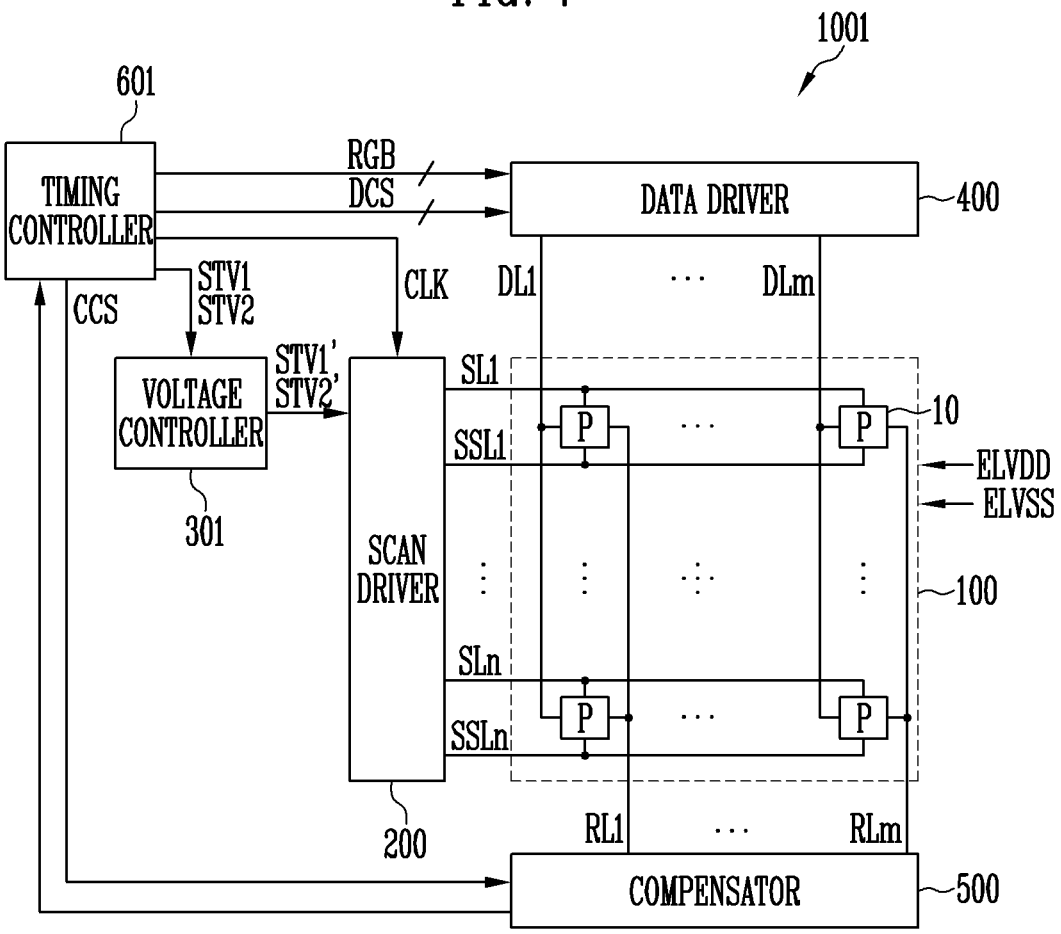
FIG. 7 is a block diagram illustrating a display device in accordance with some exemplary embodiments of the present disclosure.

FIG. 7 is a block diagram illustrating a display device 1001 in accordance with some exemplary embodiments of the present disclosure.

In FIG. 7, like reference numerals will be used to designate the same components as those described with reference to FIG. 1, and repetitive explanation of the components may be omitted. A display device 1001 of FIG. 7, other than the configuration of a voltage controller 301, may have a configuration identical or similar to that of the display device 1000 of FIG. 1.

Referring to FIGS. 1 and 7, the display device 1001 may include a display panel 100, a scan driver 200, the voltage controller 301, a data driver 400, a compensator 500, and a timing controller 601.

The timing controller 601 may provide clock signals CLK to the scan driver 200. The timing controller 601 may supply a scan start signal STV1 to the voltage controller 301.

The voltage controller 301 may control a gate-on voltage of the scan start signal STV1. For example, the voltage controller 301 may generate a compensated scan start signal STV1' obtained by applying a kickback slice voltage to the scan start signal STV1.

The voltage controller 301 may control a gate-on voltage of the sensing start signal STV2. For example, the voltage controller 301 may generate a compensated sensing start signal STV2' obtained by applying a kickback slice voltage to portion of the sensing start signal STV2.

During a mobility sensing period, the scan driver 200 may output a scan signal and a sensing signal having the same or substantially the same as waveforms as those of FIG. 3 or 5 in response to the compensated scan start signal STV1', the compensated sensing start signal STV2', and the clock signals CLK.

In other words, in the embodiment of FIG. 7, the output of the scan signal and the sensing signal may be controlled by controlling the voltage levels of the scan start signal STV1 and the sensing start signal STV2 to be input to the scan driver 200.

As described above, in the display device 1001 and a method of driving the display device 1001 in accordance with embodiments of the present disclosure, since during the mobility sensing period MSP a kickback slice is applied to the scan signal Si and the sensing signal SSi and then the sensing signal SSi is increased to the first voltage V1 again, the third transistor T3 may stably remain turned on during the current sensing period (i.e., the third period P3). Therefore, a loss of sensing current due to kickback and/or the kickback slice may be removed (or substantially reduced or minimized), and the mobility sensing accuracy may be enhanced.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

It will also be understood that when an element or component is referred to as being "between" two elements or components, it can be the only element or component between the two elements or components, or one or more intervening elements or components may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as defined by the following claims, and equivalents thereof.

What is claimed is:

1. A display device comprising:

a display panel comprising a pixel coupled to a data line, a read-out line, a scan line, and a sensing line;

a scan driver configured to generate a scan signal and a sensing signal to be respectively supplied to the scan line and the sensing line;

a voltage controller configured to control a gate-on voltage of each of the scan signal and the sensing signal to be supplied to the pixel during a mobility sensing period;

a data driver configured to supply a data signal to the data line; and a compensator configured to sense current flowing from the pixel to the read-out line and compensate for the data signal, wherein the mobility sensing period comprises a first period during which each of the scan signal and the sensing signal has a first voltage, a second period during which the gate-on voltage of each of the scan signal and the sensing signal changes, and a third period during which the sensing signal has the first voltage again.

2. The display device according to claim 1, wherein, during the second period, each of the scan signal and the sensing signal is reduced to a second voltage.

3. The display device according to claim 2, wherein, during the third period, the scan signal has a third voltage lower than the second voltage.

4. The display device according to claim 3, wherein each of the first voltage and the second voltage is the gate-on voltage, and the third voltage is a gate-off voltage.

5. The display device according to claim 3, wherein a falling time at which the scan signal changes from the second voltage to the third voltage synchronizes with a rising time at which the sensing signal changes from the second voltage to the first voltage.

6. The display device according to claim 2, wherein the voltage controller comprises:

a multiplexer configured to output, in response to a first voltage control signal and a second voltage control signal, one of the first voltage and a kickback slice voltage that changes from the first voltage to the second voltage.

7. The display device according to claim 6, wherein, during the second period, each of the scan signal and the sensing signal is reduced from the first voltage to the second voltage at a set rate.

8. The display device according to claim 1, wherein, during the mobility sensing period, a period during which the sensing signal has the first voltage is longer than a period during which the scan signal has the first voltage.

9. The display device according to claim 1, wherein the mobility sensing period comprises a plurality of first to third periods for each pixel row.

10. The display device according to claim 1, wherein the pixel comprises:

an organic light-emitting diode;

a first transistor coupled between a first driving power supply and an anode electrode of the organic light-emitting diode, and comprising a gate electrode coupled to a first node;

a second transistor coupled between the data line and the first node, and comprising a gate electrode configured to receive the scan signal;

a third transistor coupled between the read-out line and the anode electrode of the organic light-emitting diode, and comprising a gate electrode configured to receive the sensing signal; and a storage capacitor coupled between the first node and the anode electrode of the organic light-emitting diode.

11. A method of driving a display device, the method comprising:

during a first period of a frame, supplying, from a scan driver, a scan signal having a first voltage to a k-th scan line (k being a natural number) and supplying, from the scan driver, a sensing signal having the first voltage to a k-th sensing line;

during a second period of the frame, changing each of the scan signal and the sensing signal from the first voltage to a second voltage; and during a third period of the frame, supplying the sensing signal having a voltage higher than the second voltage.

12. The method according to claim 11, wherein the first voltage is higher than the second voltage.

13. The method according to claim 12, wherein, during the third period, the scan signal has a third voltage lower than the second voltage.

14. The method according to claim 13, wherein each of the first voltage and the second voltage is a gate-on voltage, and the third voltage is a gate-off voltage.

15. The method according to claim 13, wherein a falling time at which the scan signal changes from the second voltage to the third voltage synchronizes with a rising time at which the sensing signal changes from the second voltage to the first voltage.

16. The method according to claim 12, wherein, during the second period, each of the scan signal and the sensing signal is reduced from the first voltage to the second voltage at a set rate.

17. The method according to claim 11, wherein the first to third periods are during a mobility sensing period of a driving transistor of each of pixels in a k-th pixel row.

18. The method according to claim 17, wherein the first to third periods are sequentially applied on a pixel row basis.

19. The method according to claim 17, wherein the first to third periods are during a blank period of a frame and are selectively applied to some pixel rows.

* * * * *